US009682817B2

(12) United States Patent
Rudiak

(10) Patent No.: US 9,682,817 B2
(45) Date of Patent: Jun. 20, 2017

(54) ORGANIC WASTE CONTAINER SYSTEM AND METHOD OF USE

(71) Applicant: Jared W. Rudiak, Austin, TX (US)

(72) Inventor: Jared W. Rudiak, Austin, TX (US)

( * ) Notice: Subject to any disclaimer, the term of this patent is extended or adjusted under 35 U.S.C. 154(b) by 0 days.

(21) Appl. No.: 14/996,029

(22) Filed: Jan. 14, 2016

(65) Prior Publication Data

US 2016/0207705 A1 Jul. 21, 2016

Related U.S. Application Data

(60) Provisional application No. 62/103,732, filed on Jan. 15, 2015.

(51) Int. Cl.

| | |
|---|---|
| ***B65D 25/04*** | (2006.01) |
| ***B65D 51/00*** | (2006.01) |
| ***B65F 1/06*** | (2006.01) |
| ***B65F 1/16*** | (2006.01) |
| ***F25D 23/04*** | (2006.01) |
| ***B65F 1/00*** | (2006.01) |
| *B65D 25/16* | (2006.01) |
| *B65F 1/14* | (2006.01) |

(52) U.S. Cl.

CPC ..... *B65F 1/06* (2013.01); *B65F 1/0046* (2013.01); *B65F 1/16* (2013.01); *F25D 23/04* (2013.01); *B65F 2001/1489* (2013.01); *B65F 2001/1676* (2013.01)

(58) Field of Classification Search

CPC ..... B65F 1/06; B65F 1/16; B65F 2001/1676; F25D 23/028; F25D 23/04; F25D 2201/00

USPC ..... 220/495.06, 495.11, 23.87, 802

See application file for complete search history.

(56) References Cited

U.S. PATENT DOCUMENTS

| | | | | |
|---|---|---|---|---|
| 3,951,294 | A | 4/1976 | Wilson | |
| 4,060,945 | A | 12/1977 | Wilson | |
| 4,125,394 | A | 11/1978 | Wilson | |
| 4,534,488 | A * | 8/1985 | Boggs | B65D 43/0222 220/318 |
| 4,683,674 | A | 8/1987 | Faul | |
| 5,050,768 | A * | 9/1991 | Alden | B65F 1/0046 220/533 |
| 5,096,080 | A | 3/1992 | Penny | |
| 5,190,183 | A * | 3/1993 | McNaughton | B65F 1/06 220/23.83 |

(Continued)

FOREIGN PATENT DOCUMENTS

| | | |
|---|---|---|
| CA | 2668366 | 12/2010 |
| CA | 2700861 | 11/2011 |
| WO | 2013005236 | 1/2013 |

*Primary Examiner* — J. Gregory Pickett
*Assistant Examiner* — Niki M Eloshway
(74) *Attorney, Agent, or Firm* — Law Office of Mark Brown, LLC; Christopher M. DeBacker

(57) ABSTRACT

An organic waste container allowing for organic material to be collected and refrigerated. Using this product helps minimize the mess and odors associated with food preparation within the kitchen environment. The container is designed to fit in the refrigerator (ideally on the door) and to be highly accessible when needed. The container will be used in the kitchen for collecting organic waste, and then the container will be put into the refrigerator door until it needs to be emptied. The container can include certifiable compostable bags for easy cleaning and emptying of the container.

4 Claims, 9 Drawing Sheets

(56) References Cited

U.S. PATENT DOCUMENTS

| | | | | |
|---|---|---|---|---|
| 5,562,222 | A * | 10/1996 | Jordan | H02G 3/14 220/3.8 |
| 5,766,876 | A | 6/1998 | Santiago et al. | |
| 7,172,101 | B2 * | 2/2007 | Find | A47J 41/0005 220/230 |
| 7,210,307 | B2 * | 5/2007 | Kuehl | F25C 5/182 220/828 |
| 7,625,195 | B2 | 12/2009 | Manu | |
| 2007/0062953 | A1 * | 3/2007 | Lin | B65F 1/16 220/345.5 |
| 2008/0220513 | A1 * | 9/2008 | Bucci | B65F 1/06 435/290.1 |
| 2009/0266085 | A1 | 10/2009 | Goodwin et al. | |
| 2013/0056477 | A1 * | 3/2013 | Go | F25D 25/005 220/592.02 |
| 2013/0112697 | A1 * | 5/2013 | Townsel | B65F 1/06 220/661 |
| 2014/0014671 | A1 * | 1/2014 | MacArthur | B65F 1/04 220/694 |
| 2014/0263304 | A1 * | 9/2014 | Guertin | B65D 3/04 220/4.28 |
| 2015/0076152 | A1 * | 3/2015 | Buck | B65F 1/06 220/495.08 |

* cited by examiner

Fig. 9
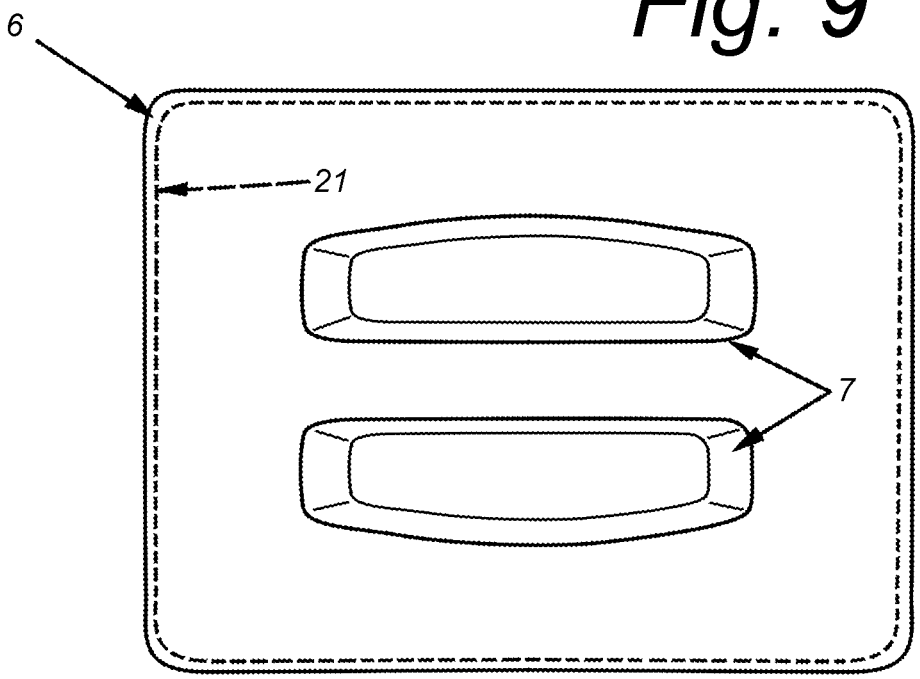
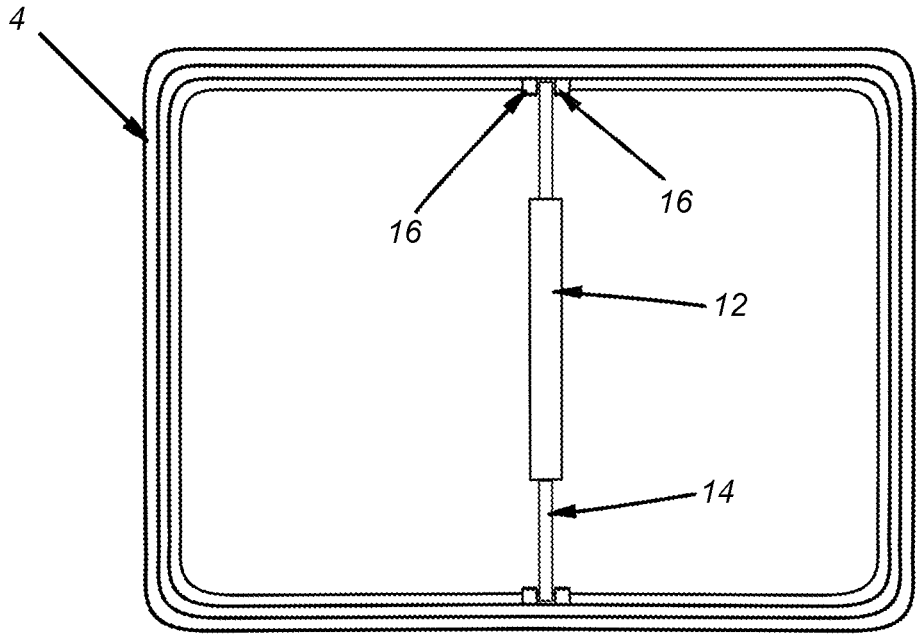
Fig. 10

ORGANIC WASTE CONTAINER SYSTEM AND METHOD OF USE

CROSS-REFERENCE TO RELATED APPLICATION

This application claims priority in U.S. Provisional Patent Application No. 62/103,732, filed Jan. 15, 2015, which is incorporated herein by reference.

BACKGROUND OF THE INVENTION

1. Field of the Invention

The present invention relates generally to an organic waste container and method for use thereof, and more specifically to an organic waste container configured for storage within a shelf of a typical consumer refrigerator.

2. Description of the Related Art

Organic waste can cause a lot of problems in the kitchen environment. Most often organic scraps are tossed into a common garbage receptacle. The smells caused by the decomposition of these materials can be very powerful and attract insects such as roaches, ants and fruit flies as well as unwanted attention from household pets. If the garbage is not emptied promptly this can cause a real problem as the smells will grow more intense.

Even a small amount of organic material can create a problem. Wanting to minimize the smell/mess, many households regularly toss out large garbage bags that are only partially full. The overuse of plastic bags is harmful to the environment.

In many regions, composting is mandatory and households collect compostable material in containers on the kitchen counter or in cabinets. Because the compost bins that exist for this purpose are meant to be stored at room temperature the compostable materials begin to smell. Many households experience insect/pest issues because of this.

Many types of compost containers exist, although none are designed to fit within a refrigerator door to be refrigerated. What is needed is a compact organic waste storage container designed for easy storage within a typical refrigerator door.

Heretofore there has not been available a system or method for an organic waste container with the advantages and features of the present invention.

SUMMARY OF THE INVENTION

The present invention generally provides an Organic Waste Container allowing for organic material to be collected and refrigerated. Using this product helps minimize the mess and odors associated with food preparation within the kitchen environment. The container is designed to fit in the refrigerator (ideally on the door) and to be highly accessible when needed.

The container is designed to be simple, and durable in its construction, with few moving parts. It is designed to be used in conjunction with plastic liners, although it can be used without them. Grocery store produce bags and/or certified compostable bags will work to suit this purpose and aid in further containing odors/mess.

The container is a size that allows for these plastic and/or certified compostable liners to be used making cleanup easy when the container becomes full. A large tightly fitting lid helps hold the plastic liners in place. An optional adjustable divider and liner securing clip may be included to allow for collected material to be separated into compostable and non-compostable within the same container (while still utilizing the bag liners). The container can be used with or without the divider, depending upon the needs of the material being collected.

The container can be placed in a work area with the lid removed to facilitate quick cleanup when a large amount of organic material needs to be disposed of. The container allows for organic material to be diverted from the regular trash and will thus help prolong the life of kitchen waste plastic bags, ultimately meaning less plastic ends up in the landfill.

The environmental benefits of the collection container are further amplified when certified compostable liners are used and the collected material is composted. This container can also be stored outside of the fridge as the tight fitting lids help reduce the smells associated with organic waste collection. It is advised to refrigerate the container to maximize the benefits of using it.

All parts of the collection system may be designed to be dishwasher safe allowing for easy cleanup. A gasket provides a seal between the lid and the base bin. Openings allow for ventilation and air movement around the certified compostable liners. A magnetic-type latch on the lid that requires minimal effort to pull apart but will ensure that the lid stays in place when not in use. A compacting tool that is used to gently compress the organic material and allow for maximum use of the available space in the container. A lid designed with a smaller hinged inset lid that allows for organic material tossed in the container by lifting the smaller hinged lid while the container remains in the fridge. A replaceable carbon filter. A handle to allow the bin to be transported and emptied easily.

BRIEF DESCRIPTION OF THE DRAWINGS

The drawings constitute a part of this specification and include exemplary embodiments of the present invention illustrating various objects and features thereof.

FIG. 9 is a top plan view of a preferred embodiment of the present invention.

FIG. 10 is a top plan view of an embodiment of the present invention as shown in FIG. 2 with the lid portion removed.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Organic Waste Container System 2

Figure 1:
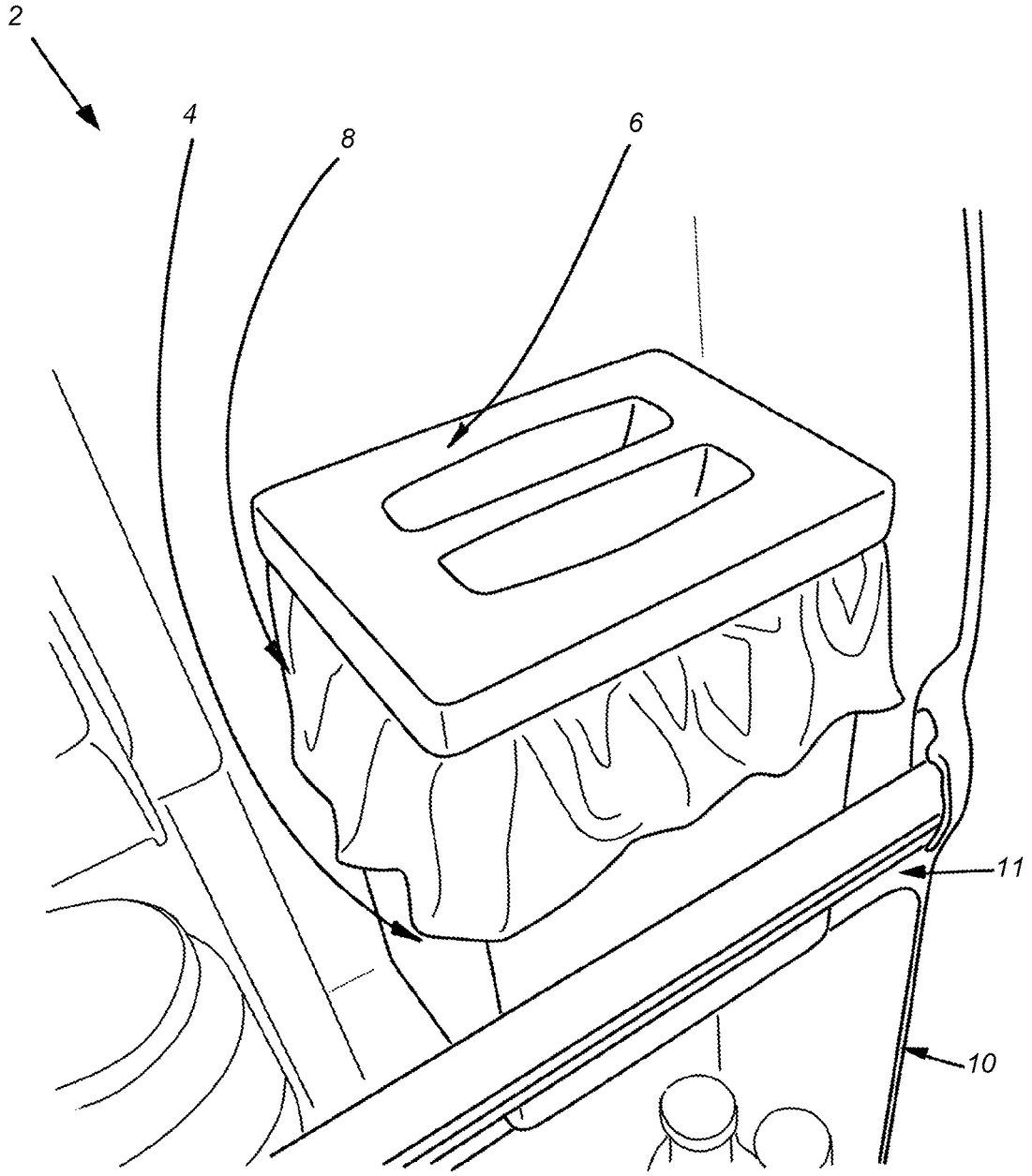
FIG. 1 is a top-down three-dimensional isometric view of a preferred embodiment of the present invention in a typical environment.

Referring to the figures, FIG. 1 shows a preferred embodiment organic waste container system 2 in a preferred environment stored within a shelf 11 of a refrigerator door 10. Generally, the container consists of a base bin 4, a lid 6, and an optional disposal liner 8 placed within the interior of the base bin 4.

Figure 2:
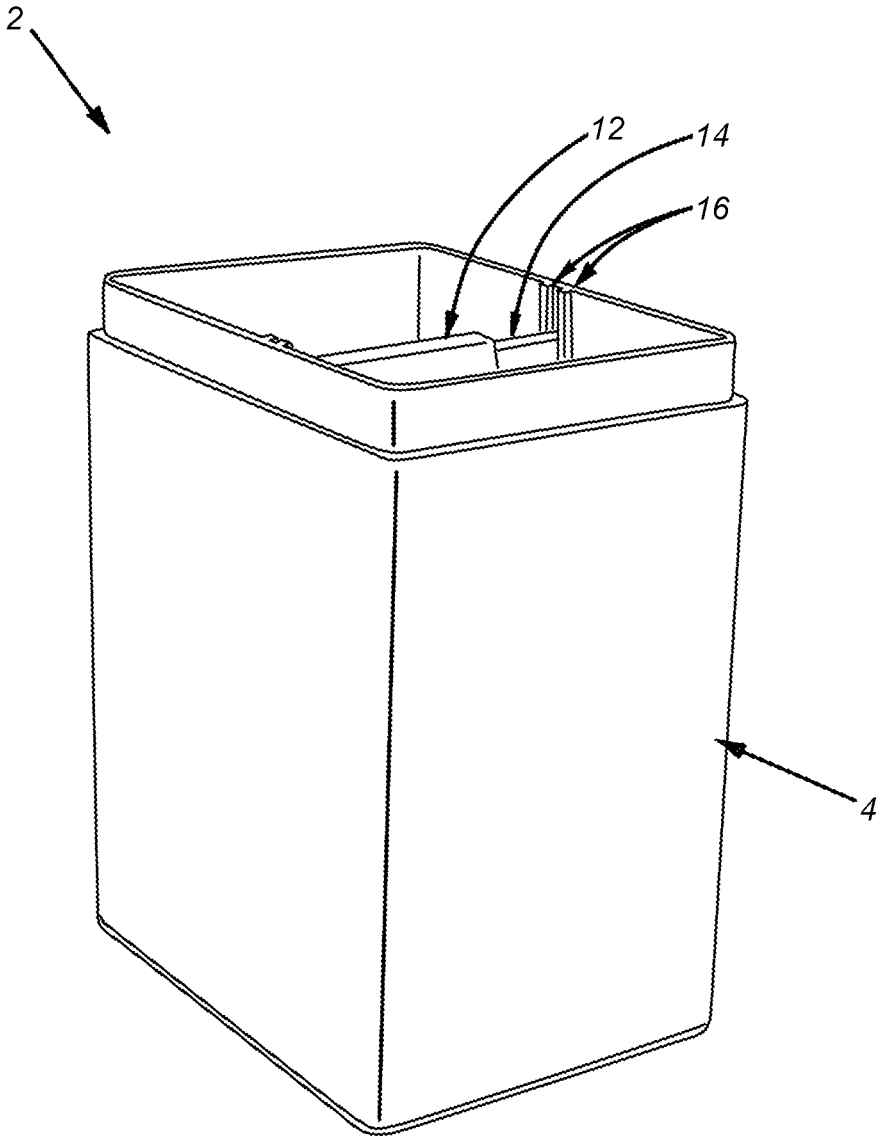
FIG. 2 is a top-down three-dimensional isometric view of a preferred embodiment of the present invention including internal elements and a removed lid portion.
Figure 3:
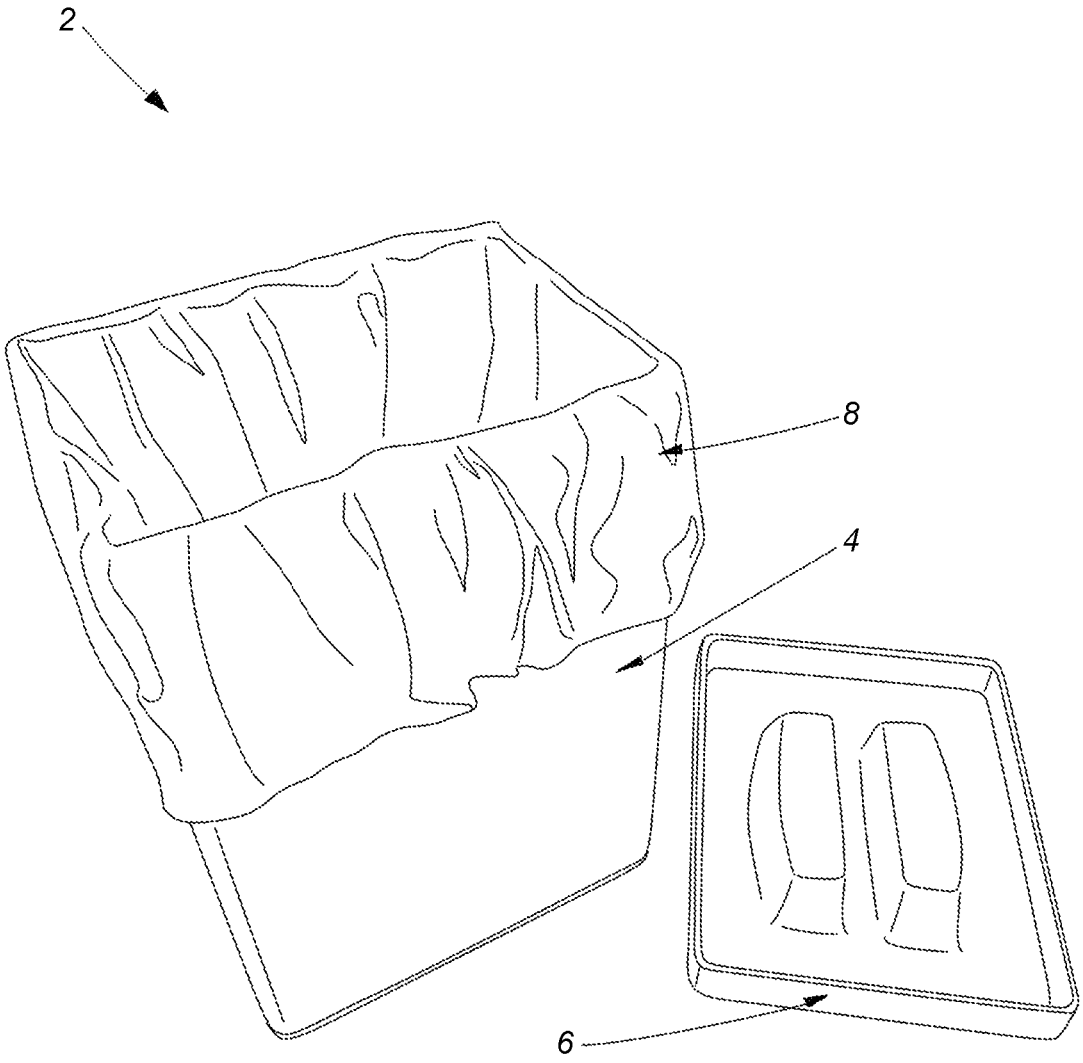
FIG. 3 is a three-dimensional exploded isometric view thereof.

FIGS. 2-3 show the base bin 4 including divider guides 16 for receiving a divider 14 which allows the bin 4 to be divided into separate chambers for separating out different types of waste (e.g. compostable vs. non-compostable waste). A clip 12 clips onto the divider 14 and helps to secure the liner bag 8 within each chamber.

Figure 4:
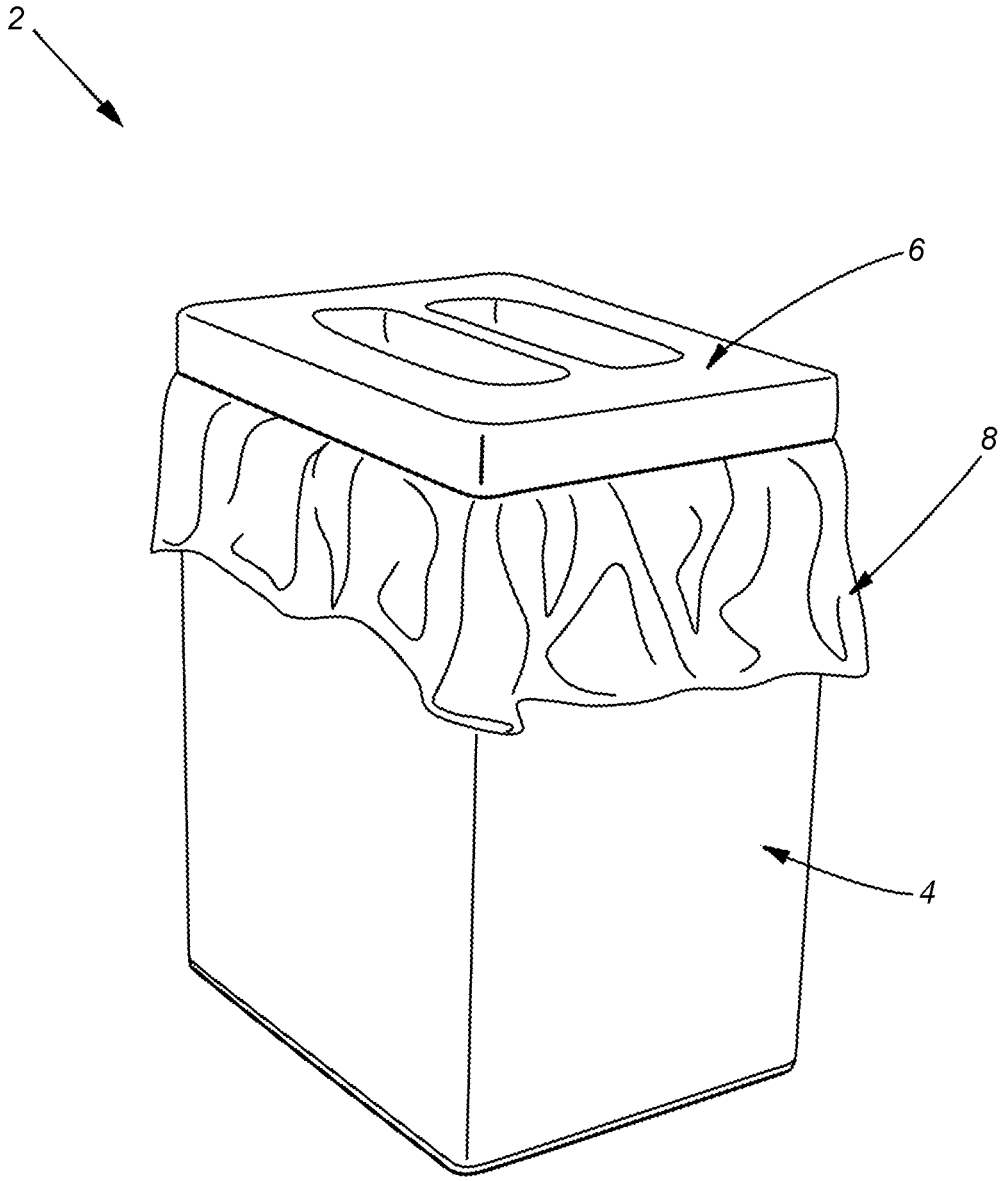
FIG. 4 is a top-down three-dimensional isometric view of a preferred embodiment of the present invention including a liner bag.
Figure 5:
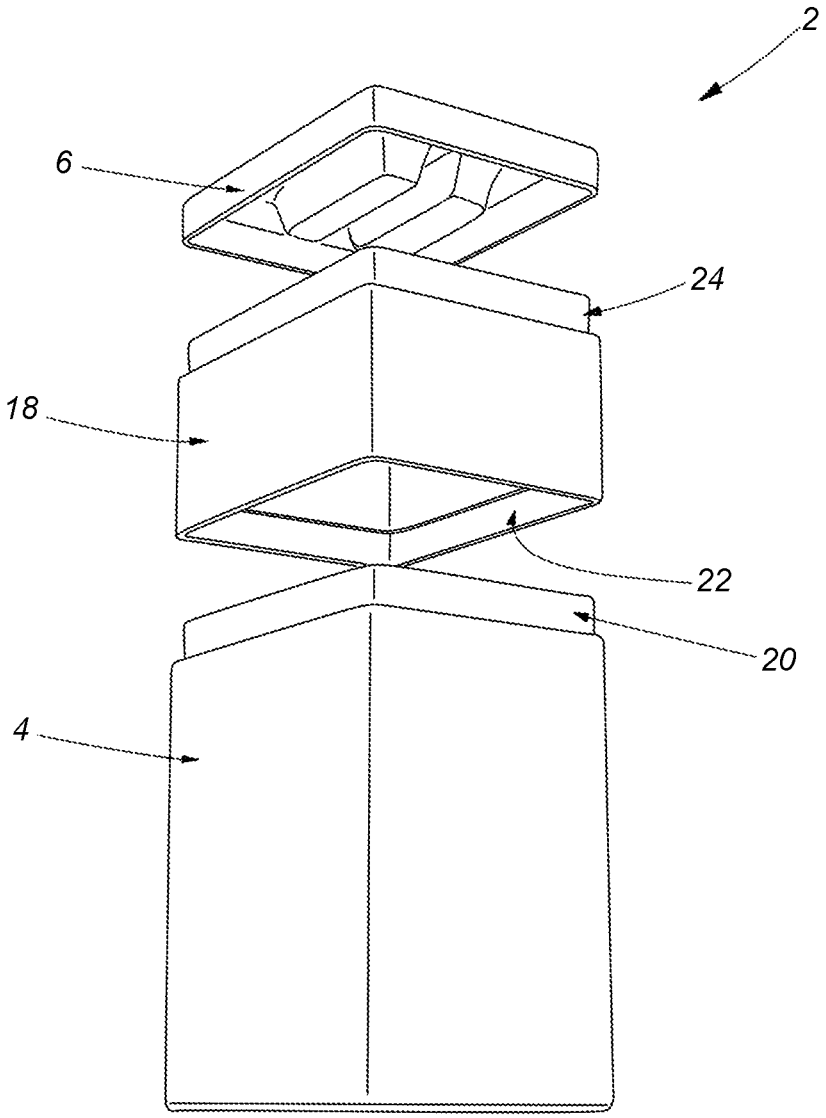
FIG. 5 is a top-down three-dimensional isometric view thereof wherein the lid element is enclosing the liner bag.

FIGS. 4-5 show the present invention without the divider 14 in use.

Figure 6:
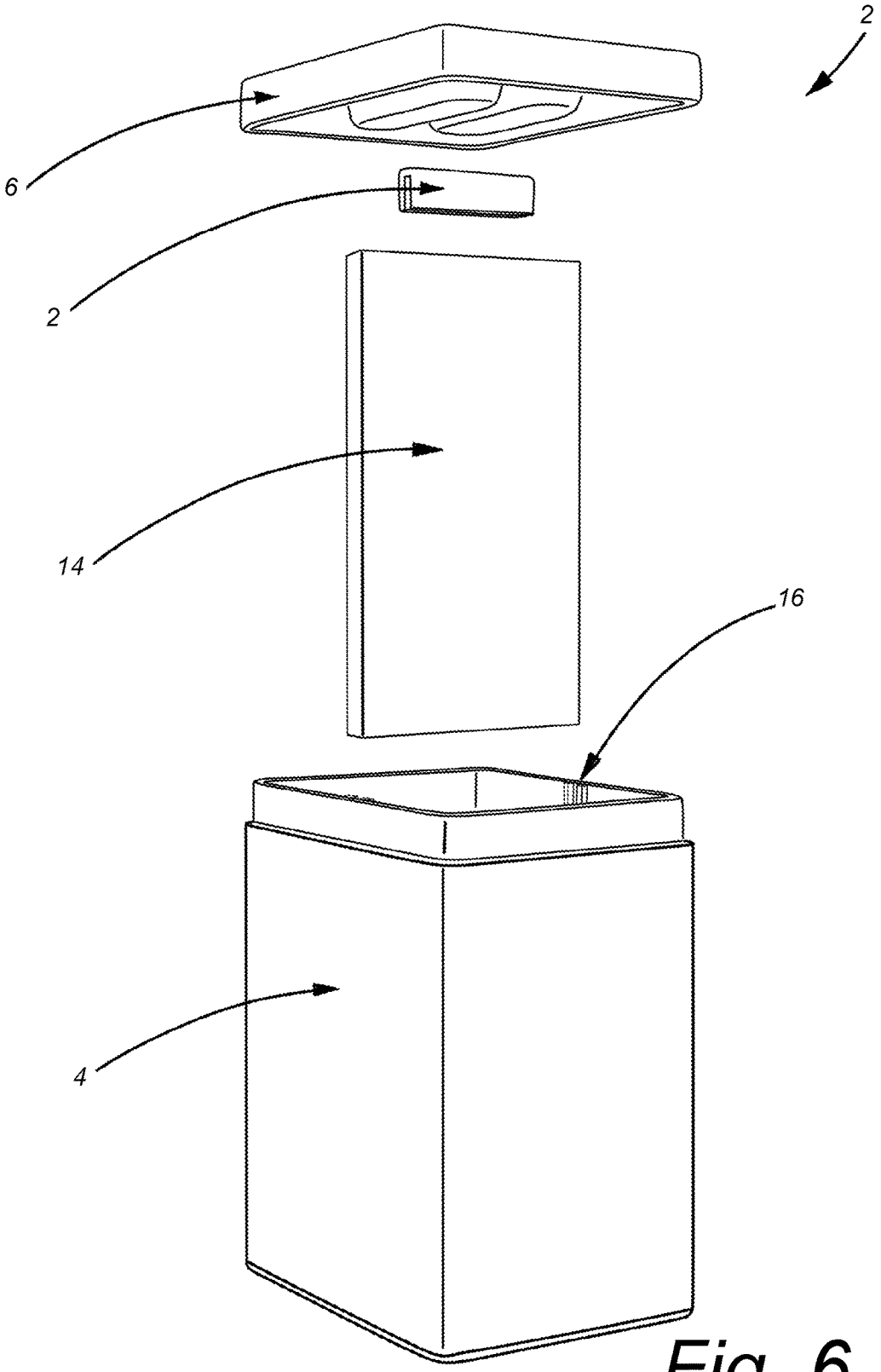
FIG. 6 is an exploded three-dimensional isometric view of an embodiment of the present invention including a second stacked portion.
Figure 7:
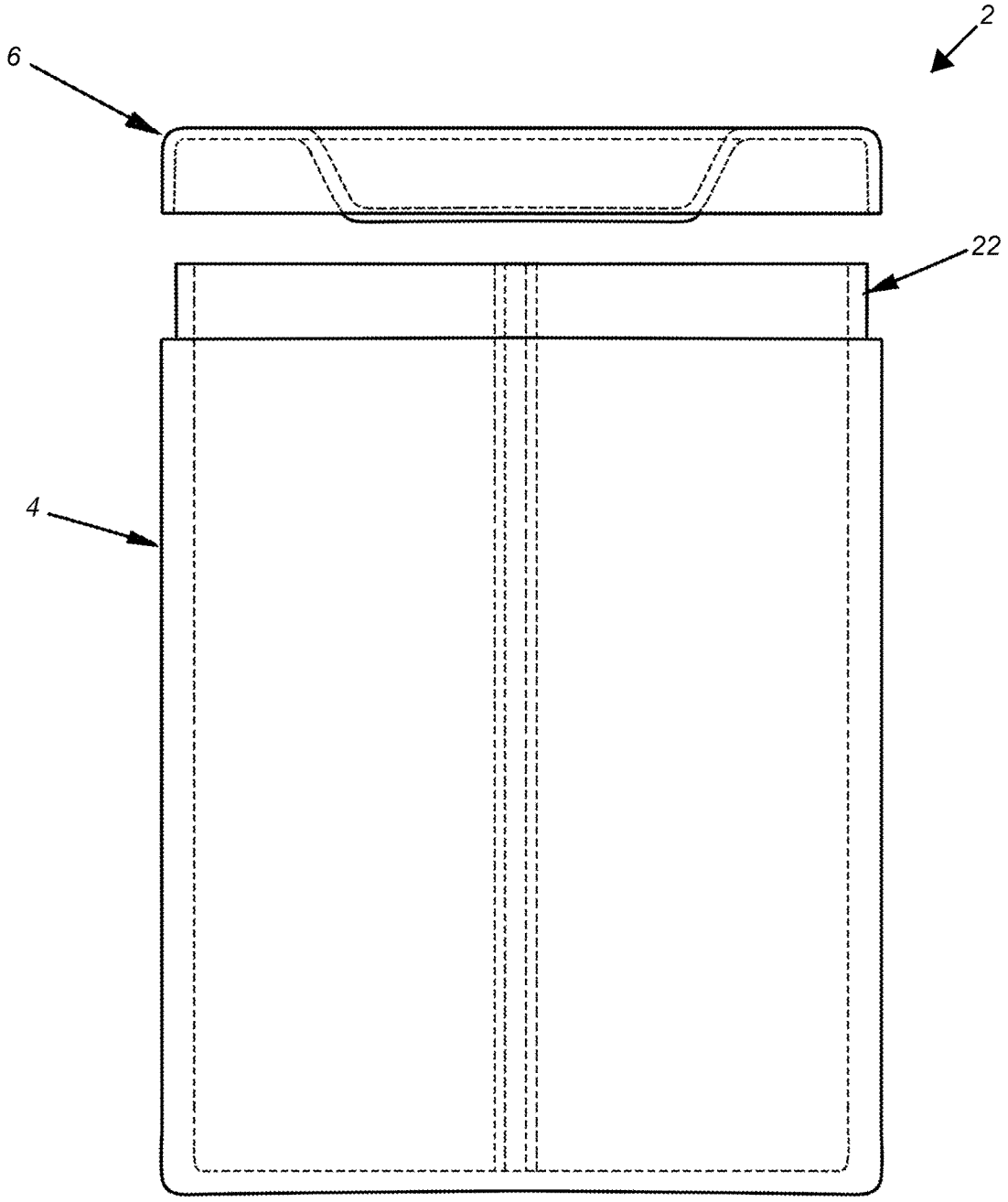
FIG. 7 is a front elevational view of a preferred embodiment of the present invention.
Figure 8:
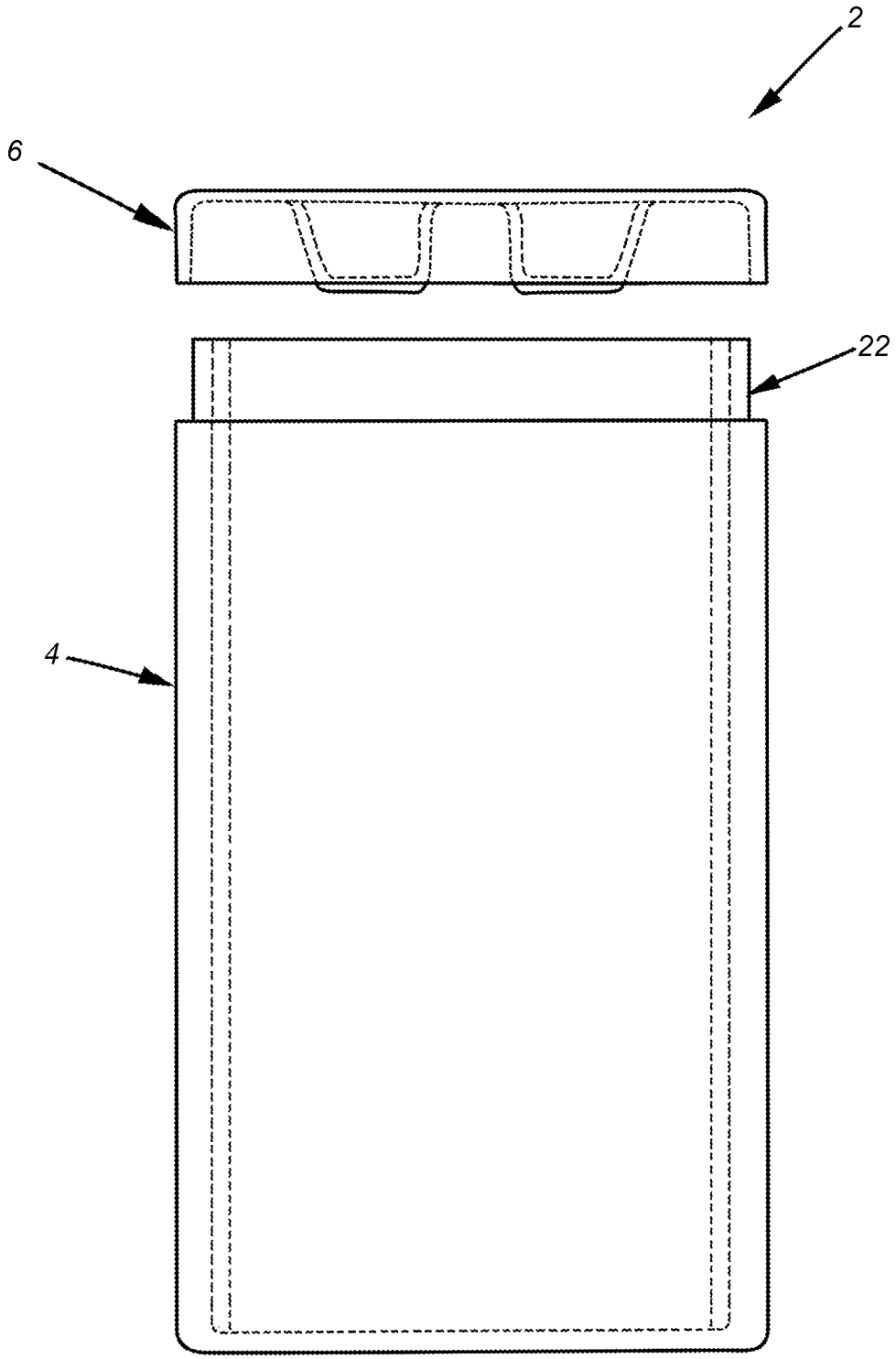
FIG. 8 is a side elevational view of a preferred embodiment of the present invention.

FIG. 6 shows an embodiment of the present invention where a second bin 18 is stacked atop the original bin 4. The base bin 4 includes a top portion 20 which receives the inner lip 21 of the lid 6 or a hollow base 22 of the second bin 18. The second bin 18 similarly includes a top portion 24 for receiving the lid 6 or other bins. This could allow for the stacking of multiple bins. FIG. 9 shows handle indents 7 within the lid 6 which make it easier for the user to remove the lid 6 from the base bin 4. Alternatively, the bin and the lid could be designed such that the lid fits within the bin, the lid having a lip around its top edge which prevents the lid from fully entering the bin.

An embodiment of the present invention could include gaskets about the top portion 20 of the base bin 4 for aiding in sealing the bin with the lid.

An embodiment of the present invention may also include a magnet located within the top portion 20 of the base bin and a corresponding magnet within the lid 6 and/or the hollow base 22 of the second bin 18, which further helps to seal the interior of the bin. The top portion 24 of the second bin 18 may also include such a magnet feature.

A compacting tool may be included to gently compress the organic material and allow for maximum use of the available space in the container. The compacting tool would be designed to be small enough to be used within the chambers of the bin 4 allowing for the materials to be tamped down.

The lid 6 could include a smaller hinged inset lid that allows for organic material to be placed within the bin by lifting the smaller hinged lid while the container remains in the refrigerator.

A replaceable carbon filter may also be included in the system.

A handle may also be included to allow the bin to be transported and emptied easily.

There could be multiple sets of divider guides 16 within the interior of the bin, allowing the bin to be divided into three or more compartments, or to adjust the comparative size of the divided compartments.

All elements of the present invention would be dishwasher safe, or easily cleanable with soap and water.

The organic waste container system 2 would be placed in the kitchen while organic products are being used. Any organic waste would be placed within the bin 4. The lid 6 would then be placed on the bin, and the bin would be placed in the shelf 11 of the refrigerator door 10. The cooler temperature of the refrigerator will prevent the organic waste from decomposing, thereby preventing odors from forming and escaping the bin. The various elements of the bin (e.g. the gasket around the upper portion 20 of the bin 4) would further aid in sealing the bin to prevent odors from escaping.

Further optional elements include corresponding magnets placed in each of the upper portion 20 of the bin 4 and in the lid 6. The magnets provide additional sealing of the lid against the bin by magnetically holding the lid in place and requiring additional force to remove the lid.

The lid 6 may optionally include an inset opening which is connected to the lid via a hinge or other element. This inset allows the user access to the internal space of the bin while the container system 2 is located within the refrigerator door 10 without requiring the entire lid 6 to be removed or the entire container system 2 to be removed from the refrigerator.

The container system 2 may also include a handle located on a side of the bin 4 for allowing easy carrying of the system between the kitchen and the refrigerator door.

A replaceable carbon filter may be implemented to further reduce odors from escaping the container system.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. An organic waste container system comprising:

a lid portion having a top face and a recessed bottom face;

a bin portion having an upper portion configured to seal against said recessed bottom face of said lid portion;

said bin portion having an interior compartment configured for storing organic waste;

a refrigerator door having a shelf;

said bin portion and said lid portion configured to be combined into a container unit;

said container unit configured to be stored within said refrigerator door shelf;

a certified compostable bag placed within said bin portion;

a pair of divider guides configured to receive a removable divider, wherein said divider slideably engages said divider guides;

a bag clip configured to clip onto an edge of said divider guide, said bag clip configured to restrain said certified compostable bag within said interior compartment of said bin portion;

a gasket about said upper portion within said recessed bottom face, said gasket configured to provide an air-tight seal between said lid portion and said bin portion said lid portion including a first magnet within a wall forming and edge of said recessed bottom face; and said bin portion including a second magnet within a wall forming said upper portion, said second magnet position within said upper portion corresponding with said first magnet within said recessed bottom face such that said second magnet is magnetically drawn to said first magnet, thereby sealing said recessed bottom face against said upper portion.

2. The container system of claim 1, further comprising:

said lid portion top face comprised of a pair of indentions separated by a flat strip; and said pair of indentions and flat strip configured for gripping of said lid portion.

3. The container system of claim 1, further comprising:

a secondary bin portion having an upper portion configured to seal against said recessed bottom face of said lid portion and a recessed bottom face configured to receive said bin portion upper portion; and said secondary bin portion having an interior compartment configured for storing organic waste.

4. A method of using and organic waste container, the method comprising the steps:

placing a waste container on a surface exterior to a refrigerator, said waste container comprising a lid portion having a top face and a recessed bottom face and a bin portion having an upper portion configured to seal against said recessed bottom face of said lid portion;

removing said lid portion from said base portion, said lid portion comprising a gasket about said recessed bottom face, said gasket configured to provide an air-tight seal between said lid portion and said bin portion, said lid portion further including a first magnet within a wall forming and edge of said recessed bottom face;

sliding a removable divider within a pair of divider guides, thereby dividing an interior space of said waste container;

clipping a bag clip onto said divider, such that said bag clip restrains said certified compostable bag within said interior compartment of said bin portion;

placing a certified compostable bag placed within said bin portion;

placing organic waste within an interior compartment of said bin portion within said compostable bag;

placing said lid portion onto said bin portion such that said upper portion fits within said recessed bottom face;

said bin portion including a second magnet within a wall forming said upper portion, said second magnet position within said upper portion corresponding with said first magnet within said recessed bottom face such that said second magnet is magnetically drawn to said first magnet, thereby sealing said recessed bottom face against said upper portion;

opening a door said refrigerator, said door including an interior space having a shelf; and storing said waste container within said shelf.

* * * * *